United States Patent [19]

Wood

[11] 4,029,205

[45] June 14, 1977

[54] ARTICLE CARRIER

[75] Inventor: Prentice J. Wood, Hapeville, Ga.

[73] Assignee: The Mead Corporation, Dayton, Ohio

[22] Filed: June 28, 1976

[21] Appl. No.: 700,227

[52] U.S. Cl. ..... 206/173; 206/188; 229/DIG. 9

[51] Int. Cl.[2] ..... B65D 5/48; B65D 75/00; B65D 81/00

[58] Field of Search ..... 206/170, 193; 229/DIG. 9

[56] References Cited

UNITED STATES PATENTS

| | | | |
|---|---|---|---|
| 2,658,659 | 11/1953 | Hall | 206/172 |
| 3,138,285 | 6/1964 | Wenzel | 206/186 |
| 3,203,585 | 8/1965 | Wood | 206/188 |
| 3,383,010 | 5/1968 | Wainberg | 206/191 |
| 3,567,069 | 3/1971 | Harrelson | 229/DIG. 9 |
| 3,572,543 | 3/1971 | Forrer et al. | 206/188 X |
| 3,651,982 | 3/1972 | Slevin | 229/DIG. 9 |
| 3,857,483 | 12/1974 | Wood | 206/188 X |

*Primary Examiner*—Stephen Marcus
*Attorney, Agent, or Firm*—Walter M. Rodgers; Walter A. Rodgers

[57] ABSTRACT

An article carrier blank comprising a bottom wall, a side wall foldably joined to a side edge of the bottom wall, a pair of end wall panels foldably joined respectively to the end edges of the side wall, a pair of riser panels foldably joined respectively to the end wall panels along the edges thereof remote from the side wall, a locking notch formed in one of the riser panels at one end of the blank, a stabilizing tab integral with the other of the riser panels at the other end of the blank and comprising a heel portion and a toe portion and a notch, the toe portion extending inwardly and the notch opening inwardly with respect to the blank and the heel portion extending outwardly beyond the adjacent end edge of the blank and adapted respectively to nest with the locking notch of an adjacent blank, and a locking aperture formed in the bottom wall.

7 Claims, 5 Drawing Figures

ARTICLE CARRIER

Article carriers are known in which a double lock is formed in the bottom of the carrier. In one arrangement a conventional lock is formed in a riser panel of normal width at one end of the carrier and a second lock is formed at the other end of the carrier by combining a stabilizing tab formed in a wide riser panel and having a notch portion and a locking aperture which is spaced an appropriate distance inwardly from the end of the bottom wall. More recently it has become customary to narrow the width of the carrier riser panels to effect a saving of material. Narrowing of the wide riser panel is feasible only if effected without substantially changing the location of the stabilizing tab.

Thus this invention is concerned with saving material without impairing package stability by projecting the stabilizing tab beyond the end edge of the blank while eliminating other areas of the riser panel and by nesting such tab with a locking notch of an adjacent blank.

According to this invention an article carrier blank is provided and comprises a bottom wall, a first side wall foldably joined to a side edge of the bottom wall, a first pair of end walls panels foldably joined respectively to the end edges of said first side wall, a first pair of riser panels foldably joined respectively to the first pair of end wall panels along the edges thereof remote from the first side wall, a first pair of handle panels foldably joined along their outer end edges respectively to the first pair of riser panels, a second pair of handle panels foldably joined respectively to the top edges of the first pair of handle panels, a second pair of riser panels foldably joined respectively to the second pair of handle panels along the outer end edges thereof, a second pair of end wall panels foldably joined respectively to the second pair of riser panels along the inner edges thereof, a second side wall foldably joined respectively along the end edges thereof to the edges of said second pair of end wall panels remote from the second pair of riser panels, a pair of locking notches formed respectively in the riser panels at one end of the carrier, a pair of stabilizing tabs integral respectively with the riser panels at the other end of the carrier and each comprising a heel portion and a toe portion and a notch each of the notches opening inwardly with respect to the blank the heel portions extending beyond the end edge of the blank at the other end of the carrier and adapted respectively to nest with said locking notches of an adjacent blank to effect a significant saving of material, and a locking aperture formed in the bottom wall, the adjacent blank being struck from the same sheet of material as the article carrier blank.

For a better understanding of the invention, reference may be had to the following detailed description taken in conjunction with the accompanying drawings in which FIG. 1 is an isometric view of a set up carrier constructed according to this invention;

FIG. 2 is a plan view of a blank from which the carrier depicted in FIG. 1 is formed with portions of adjacent blanks shown in dotted lines; and in which

Figure 1A:
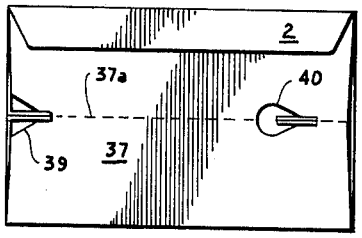
FIG. 1A is a bottom view of the carrier depicted in FIG. 1.

In the drawings the numeral 1 designates a side wall of the carrier to the bottom edge of which a glue flap 2 is foldably joined along fold line 3. An end wall panel 4 is foldably joined along fold line 5 to one end of the side wall 1 while a similar end wall panel 6 is foldably joined along fold line 7 to the other end of side wall 1. A riser panel 8 is foldably joined to one edge of end panel 4 along fold line 9 and a similar riser panel 10 is foldably joined to one edge of end wall panel 6 along fold line 11. A first handle panel 12 is foldably joined to second handle panel 13 along medial fold line 14 and to riser panel 8 along fold line 9.

At the other end of the carrier a second pair of handle panels designated by the numerals 15 and 16 are foldably joined together along medial fold line 17. Handle panel 15 is foldably joined to riser panel 10 along fold line 11. Hand gripping apertures 18 and 19 are formed respectively in handle panels 12 and 13 while hand gripping apertures 20 and 21 are formed respectively in handle panels 15 and 16. In order to allow additional comfort while the carrier is being transported, hand cushioning flaps 22 and 23 are provided and are foldably joined respectively to handle panels 15 and 16 along fold lines 24 and 25. To provide additional carrier strength in the area of the handle, reinforcing tab 26 is provided and is foldably joined to handle panel 13 along fold line 27.

The opposite side of the carrier is similar in construction to those portions of the carrier blank described above and comprises a riser panel 28 foldably joined along fold line 29 to end wall panel 30 and to handle panel 13. End wall panel 30 is foldably joined along fold line 31 to side wall 32. In like fashion, end wall panel 33 is foldably joined to the other end of side wall 32 along fold line 34 and riser panel 35 is foldably joined along fold line 36 to end wall panel 33 to handle panel 16.

Bottom wall 37 is foldably joined along fold line 38 to the bottom edge of the side wall 32 and is provided with a medial fold line **37*a* at one end of which a V-shaped notch 39 is formed. In addition locking aperture 40 is formed in bottom wall 37 generally remote from V-shaped notch 39.**

In order to provide transverse separating means for articles disposed on either side of the handle structure, a plurality of transverse partitioning straps are provided and, on one side of the carrier, are designated by the numerals 41 and 42. Strap 41 is foldably joined to high center portion **1*a* of side wall 1 along fold line 43 and to handle panel 12 along fold line 44. In like fashion, transverse partitioning strap 42 is foldably joined at one end to high center portion 1*a* along fold line 45 and at the other end the strap 42 is foldably joined to handle panel 15 along fold line 46.**

The transverse partitioning straps on the opposite side of the carrier are similarly constructed and are designated by the numerals 47 and 48. Strap 47 is foldably joined at one end along fold line 49 to the high center portion **32*a* of side wall 32. At the other end strap 47 is foldably joined to handle panel 13 along the fold line 50. Transverse partitioning strap 48 is foldably joined along fold line 51 to high center portion 32*a* and is joined to handle panel 16 along fold line 52.**

For the purpose of cooperating with V-shaped notch 39 and thereby aid in maintaining the carrier in set up condition at one end thereof, locking notches 53 and 54 are formed in riser panels 8 and 28 respectively. According to one aspect of this invention, a pair of stabilizing tabs 55 and 56 are formed in an integral fashion respectively with riser panels 10 and 35. Stabilizing tab 55 is provided with a heel portion 57 and a toe portion 58 and likewise stabilizing tab 56 is provided with a heel portion 59 and a toe portion 60. In addition each stabilizing tab 55 and 56 is provided with a C-shaped notch portion C.

Figure 2:
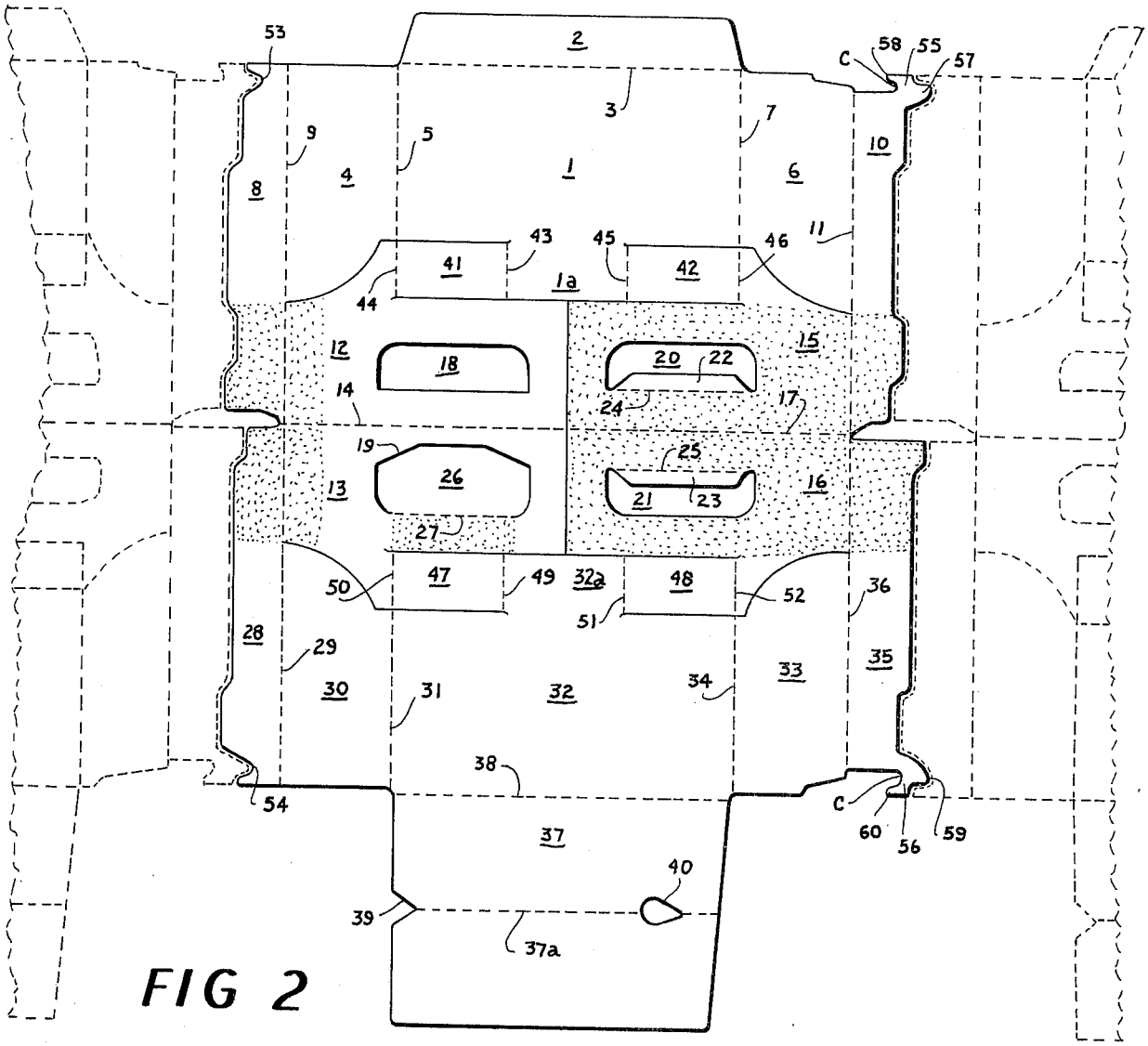
Figure 3:
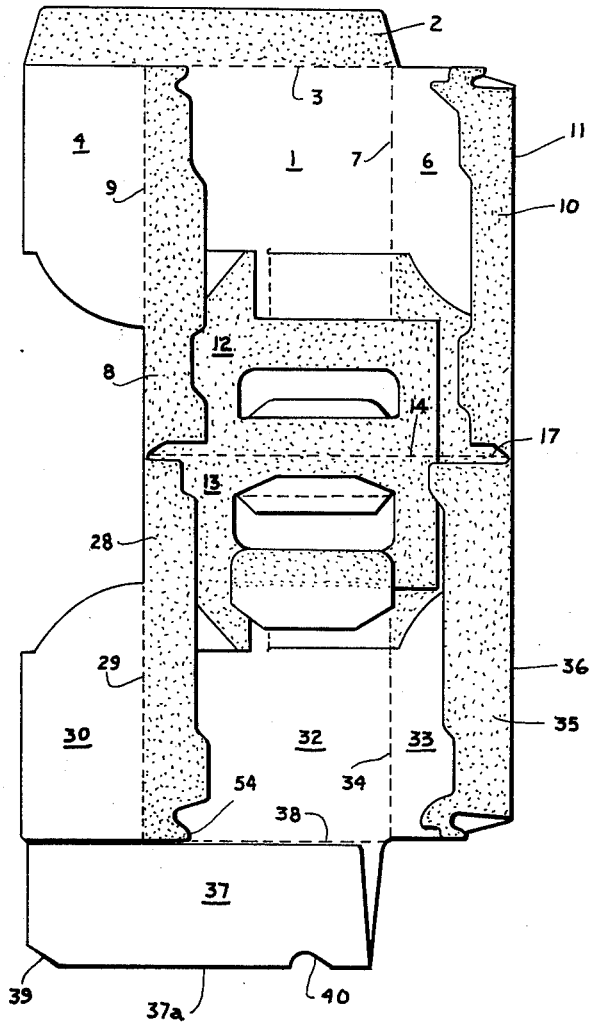
FIG. 3 is an intermediate stage through which the blank of FIG. 2 is manipulated in order to form the completed and collapsed carrier shown in FIG. 4.
Figure 4:
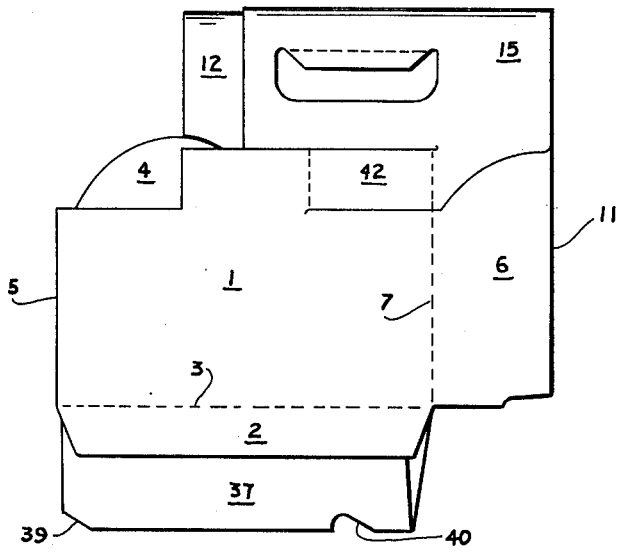

In order to form the collapsed carrier depicted in FIG. 4 from the blank depicted in FIG. 2, an application of glue is first made to the blank as indicated by stippling in FIG. 2. Thereafter, the first pair of handle panels 12 and 13 are elevated and swung toward the right and simultaneously end wall panels 4 and 30 are folded upwardly and toward the right along the fold lines 5 and 31 respectively. Simultaneously, the riser panels 8 and 28 are folded upwardly and toward the right along the fold lines 9 and 29 respectively so that the inner ends of the riser panels 8 and 28 become adhered respectively to the left hand ends of the first pair of handle panels 12 and 13. In addition the outer surfaces of handle panels 12 and 13 are adhered respectively to the inner surfaces of handle panels 15 and 16. The riser panels 10 and 35 are elevated and swung toward the left respectively along fold lines 11 and 36. By this operation riser panels 10 and 35 are adhered to the inner surfaces of handle panels 15 and 16. Following this operation reinforcing tab 26 is elevated and folded downwardly as viewed in FIG. 2 and thereby becomes adhered to handle panel 13. Thereafter the bottom wall 37 is folded along the medial fold line 37*a* by simply folding the lower portion thereof upwardly and over into flat face contacting relation with the upper portion as depicted in FIG. 3. The blank then appears as shown in FIG. 3.

In order to complete the carrier an application of glue is made to the blank as indicated by stippling in FIG. 3. Thereafter the side wall 1, glue flap 2, end wall panels 4 and 6, riser panels 8 and 10, and handle panels 12 and 15 are folded upwardly and forwardly along the fold lines 14 and 17 into flat face contacting relation with the remaining portions of the blank to occupy positions as depicted in FIG. 4, i.e., to form the completed carrier in collapsed condition.

Figure 1:
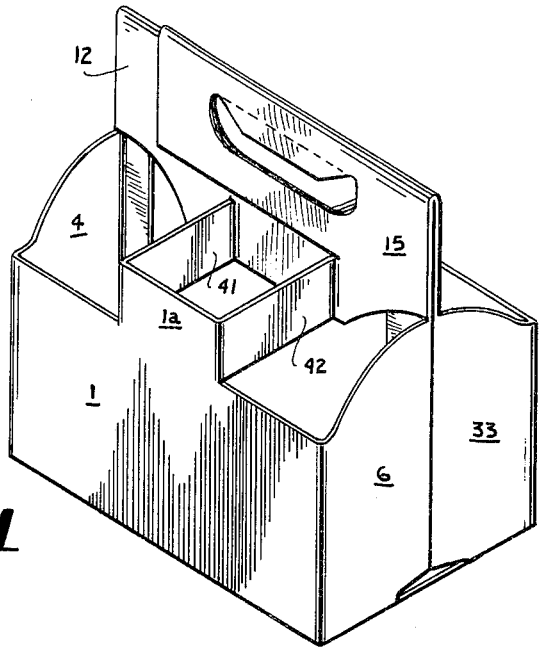

In order to set up the carrier from its collapsed condition as depicted in FIG. 4, pressure is applied to the inner edges of end panels 6 and 33 to urge the side walls 1 and 32 apart. This causes the locking notches 53 and 54 to engage V-shaped notch 39 as is well known. Simultaneously with this operation heel portions 57 and 59 of stabilizing tabs 55 and 56 are caused to enter locking aperture 40. As the side walls 1 and 32 continue to move apart, the toe portions 58 and 60 of stabilizing tabs 55 and 56 are caused to enter locking aperture 40. Following this, as best seen in FIG. 1A, the natural "fight" in the carrier itself causes the locking notches 53 and 54 to engage the apex of V-shaped notch 39 and also causes C-shaped notch C of stabilizing tabs 55 and 56 to engage the right hand end of locking aperture 40, as viewed in FIG. 1A. Thereafter the carrier appears as depicted in FIG. 1 which represents a carrier which has a bottom panel that is virtually flat when the carrier is set up. Therefore a carrier is provided which is not prone to "rocking" back and forth due to a bowed bottom panel which is common in carriers having a conventional single lock at one end of the bottom wall.

Since the inherent "fight" in the carrier urges the bottom wall to move in a longitudinal direction relative to the carrier side walls, portions of the bottom panel must bias against both the locking notch and the stabilizing tab in the double lock arrangement. To provide one biasing surface, the locking aperture 40 must be spaced a distance from the end of the bottom wall which is opposite to the end of the bottom wall having the V-shaped notch 39. In order for the heel portions of the stabilizing tabs to extend inwardly to the locking aperture in the set up carrier, they must extend beyond the associated end edge of the unformed carrier blank. By this invention the heel portion has been configured in such a manner as to nest with the corresponding locking notch of an adjacent carrier blank. Due to the extremely large volume of manufacture of article carriers, this nesting feature provides a very significant saving in the quantity of paperboard material used in the manufacturing process.

The embodiments of the invention in which an exclusive property or privilege is claimed are defined as follows:

1. An article carrier blank comprising a bottom wall, a first side wall foldably joined at a side edge of said bottom wall, a first pair of end wall panels foldably joined respectively to the end edges of said first side wall, a first pair of riser panels foldably joined respectively to said first pair of end wall panels along the edges thereof remote from said first side wall, a first pair of handle panels foldably joined along their outer end edges respectively to said first pair of riser panels, a second pair of handle panels foldably joined respectively to the top edges of said first pair of handle panels, a second pair of riser panels foldably joined respectively to said second pair of handle panels along the outer end edges thereof, a second pair of end wall panels foldably joined respectively to said second pair of riser panels along the inner edges thereof, a second side wall foldably joined respectively along the end edges thereof to the edges of said second pair of end wall panels remote from said second pair of riser panels, a pair of locking notches formed respectively in the riser panels at one end of the carrier blank, a pair of stabilizing tabs integral respectively with the riser panels at the other end of the carrier blank and each comprising a heel portion and a toe portion and a notch, said toe portions extending inwardly with respect to said blank and each of said notches opening inwardly with respect to said blank, said heel portions extending outwardly beyond the end edge of said blank at said other end of the carrier blank and adapted respectively to nest with the locking notches of an adjacent blank, and a locking aperture formed in said bottom wall, said adjacent blank being struck from the same sheet of material as said article carrier blank.

2. A blank according to claim 1 wherein a V-shaped notch is formed at one end of said bottom panel and positioned an equal distance from the side edges of said bottom panel.

3. A blank according to claim 2 wherein said locking aperture is adjacent to and spaced from the end of said bottom panel which is opposite from the end having said V-shaped notch.

4. An article carrier blank comprising a pair of handle panels foldably joined along a medial fold line, a first pair of riser panels foldably joined respectively to said pair of handle panels, a first pair of end wall panels foldably joined respectively to said first pair of riser panels along the inner edges thereof, a pair of side walls foldably joined respectively to said first pair of end wall panels remote from said first pair of riser panels, a second pair of end wall panels foldably joined respectively to said side walls along the edges thereof remote from said first pair of end wall panels, a second pair of riser panels foldably joined respectively to said second pair of end wall panels remote from said side walls, a pair of locking notches formed respectively in the riser panels at one end of the carrier blank, a pair of stabilizing tabs integral respectively with the riser panels at the other end of the carrier blank and each comprising a heel portion and a toe portion and a notch, said toe portions extending inwardly with respect to said blank and each of said notches opening inwardly with respect to said blank, said heel portions extending outwardly beyond the end edges of said blank at said other end of the carrier and adapted respectively to nest with the locking notches of an adjacent blank, and said adjacent blank being struck from the same sheet of material as said article carrier blank.

5. A blank according to claim 4 wherein a bottom wall is foldably joined to the bottom edge of one of said side walls.

6. A blank according to claim 5 wherein a locking aperture is formed in said bottom wall and wherein said locking aperture is disposed intermediate the ends of said bottom wall.

7. An article carrier blank comprising a bottom wall, a side wall foldably joined to a side edge of said bottom wall, a pair of end wall panels foldably joined respectively to the end edges of said side wall, a pair of riser panels foldably joined respectively to said end wall panels along the edges thereof remote from said side wall, a locking notch formed in one of said riser panels at one end of the blank, a stabilizing tab integral with the other of said riser panels at the other end of the blank and comprising a heel portion and a toe portion and a notch, said toe portion extending inwardly with respect to the blank and said notch opening inwardly with respect to the blank, said heel portion extending outwardly beyond the end edge of said blank at said other end of the blank and adapted respectively to nest with the locking notch of an adjacent blank, and a locking aperture formed in the bottom wall, said adjacent blank being struck from the same sheet of material as said article carrier blank.

* * * * *